US006068386A

United States Patent [19]

Pastega

[11] Patent Number: 6,068,386

[45] Date of Patent: May 30, 2000

[54] BOTTLE-SHAPED FLASHLIGHT

[76] Inventor: Kenneth R. Pastega, 1950 NW. Frazier Creek Dr., Corvallis, Oreg. 97330

[21] Appl. No.: 09/044,379

[22] Filed: Mar. 18, 1998

[51] Int. Cl.[7] ..... F21L 7/00

[52] U.S. Cl. ..... 362/205; 362/202; 362/208; 362/806

[58] Field of Search ..... 362/101, 202, 362/205, 208, 806

[56] References Cited

U.S. PATENT DOCUMENTS 2,260,639 10/1941 Powell ..... 362/208 X
4,754,379 6/1988 Kelley ..... 362/202
5,178,450 1/1993 Zelensky et al. ..... 362/154

*Primary Examiner*—Stephen Husar
*Attorney, Agent, or Firm*—Ipsolon LLP

[57] ABSTRACT

A flashlight having a body formed in the shape of a bottle, for example a soda bottle. The body of the flashlight has three body sections, a first body section having a relatively larger outside diameter that reproduces the appearance of the base of a bottle, a second body section having a relatively smaller outside diameter and which reproduces the appearance of the neck of the bottle, and a transitional body section joining the first and second body sections and which reproduces the shoulder of the bottle. The flashlight includes a lens assembly at one the end of the flashlight body that has the largest outside diameter, and a switch at the neck-end of the body.

15 Claims, 1 Drawing Sheet

48
34

48
34
38
50
51

33
48
34
36
38
20
16
34
10
40
18
42
22
14
44
46
32
33
25
26
26
30
28
24
31

2
2
X
16
12
10
18
14
Y
2
2

35
X
16
12
10
18
14
Y

BOTTLE-SHAPED FLASHLIGHT

FIELD OF THE INVENTION

The present invention relates to flashlights and, in particular, to flashlights having a body formed in the shape of a bottle.

BACKGROUND AND SUMMARY OF THE INVENTION

Portable flashlights are well known tools that are useful for a wide range of endeavors. Indeed, flashlights are so useful that one or more can be found in nearly every household in the United States. Flashlights also are commonly found in automobiles and trucks of every kind, as they are necessary in situations such as emergencies for illumination when natural light is insufficient, and to call attention to the presence of the user. In addition to being useful tools for a wide variety of work-related endeavors, flashlights may be used for recreational uses such as camping and other outdoor activities, and for many other purposes.

There are just about as many different types of flashlights as there are uses for them. To list just a few examples, there are heavy-duty flashlights, high illumination flashlights, waterproof and floating flashlights, and miniature flashlights. Given the wide variety of uses for flashlights there is a constant market for new and different kinds of flashlights.

The present invention relates to a general-purpose flashlight that has a unique body shape. Thus, the body of the flashlight of the present invention is formed in the shape of a bottle, for instance, a traditional soda bottle. The flashlight of the present invention is useful not only for its illumination capabilities, but also as a novelty item that is unique and finds many different applications and uses. For example, the flashlight may be manufactured in the shape of well-known and highly recognizable soda bottles. Such flashlights may be branded with the brand name of the appropriate soda, and marketed as a promotional item or used for other advertising purposes. The flashlight body may also be manufactured in the shape of other recognizable bottles, such as wine bottles. Miniature versions of flashlights made according to the present invention may be used as attachments to, for instance, key chains.

Additional objects and advantages of the present invention will be apparent from the detailed description of the preferred embodiment thereof, which proceeds with reference to the accompanying drawings.

DETAILED DESCRIPTION OF A PREFERRED EMBODIMENT

Figures 1, 2, 3, 4, 5:
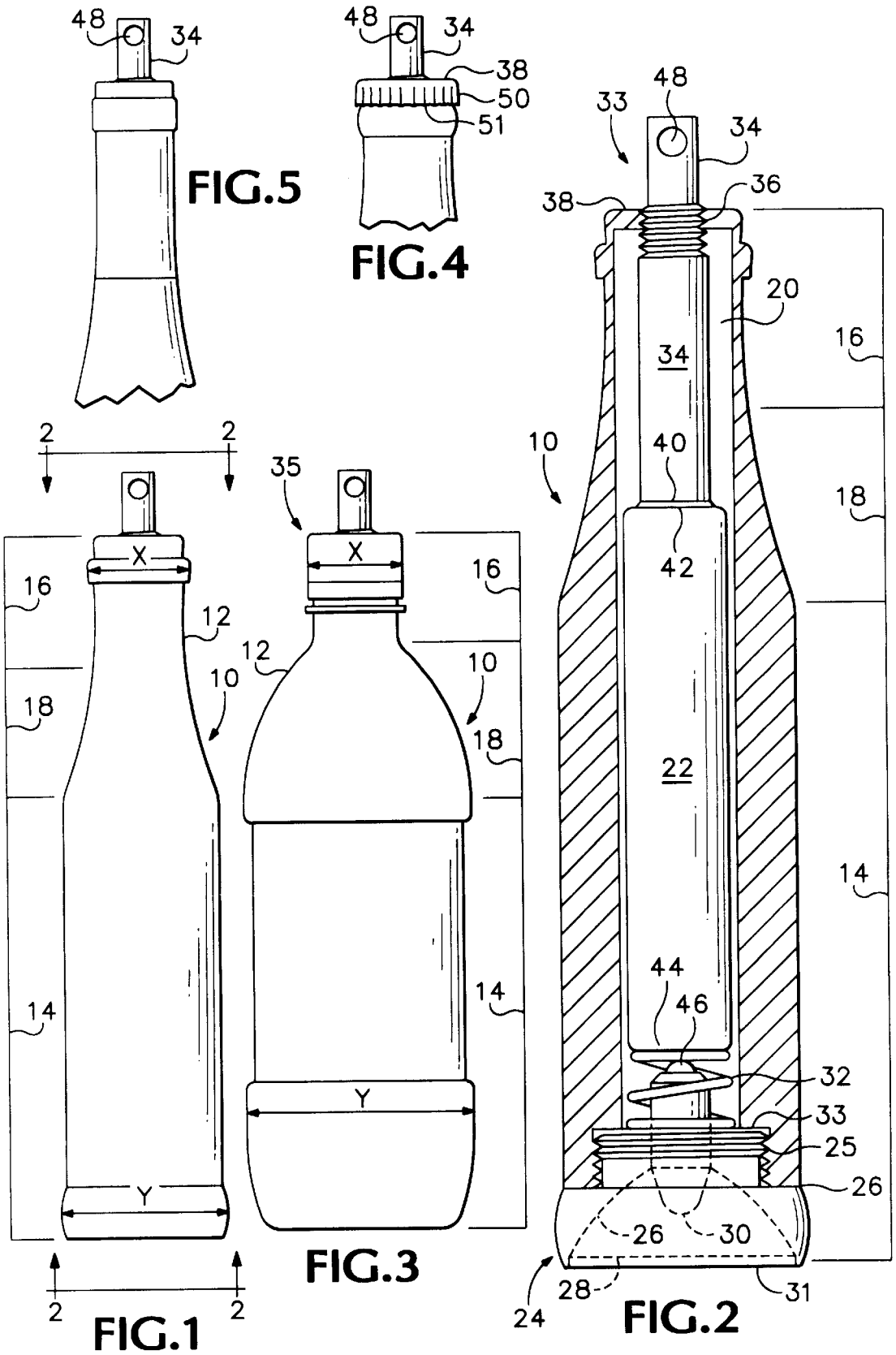
FIG. 1 is a plan view of a flashlight according to the present invention showing one embodiment of the bottle-shaped body.
FIG. 2 is a cross sectional view of the flashlight illustrated in FIG. 1, taken along the line 2—2 of FIG. 1.
FIG. 3 is a plan view of a flashlight according to the present invention having an alternative shape for the body.
FIG. 4 is a partial plan view of the neck end of a flashlight according to the present invention, illustrating a further embodiment of the neck end.
FIG. 5 is partial plan view of the neck end of a flashlight according to the present invention, illustrating yet another embodiment of the neck end.

A preferred embodiment of a flashlight 10 in accordance with the present invention is shown in FIGS. 1 and 2. The invention disclosed in this application relates to the novel shape of the flashlight body shown in the drawing figures and described herein, and in the accompanying switch mechanism used to turn the lamp on and off. Although the flashlight is described in detail below, the mechanical aspects of the flashlight of the present invention are generally conventional for flashlights, and as such are well within the skills of those of ordinary skill in the art to manufacture.

There are plainly many different shapes of bottles. Nonetheless, a flashlight 10 according to the present invention may be characterized as having a flashlight body 12 that includes three body sections. A first body section 14, a second body section 16, and a transitional body section 18 therebetween. As exemplified by the illustrations of FIGS. 1 and 3, which show flashlights having two different bottle-shaped bodies, transitional body section 18 is, in all embodiments, located between first body section 14 and second body section 16. Thus, transitional body section 18 comprises a body section where the outer diameter of the flashlight body 12 is reduced from a relatively larger outer diameter in the first body section to a relatively smaller outer diameter in the second body section.

With reference to the traditional parts of a bottle, first body section 14 represents the base, or main fluid-holding portion of the bottle. Transitional body section 18 represents the shoulder section of the bottle, and second body section 16 represents the neck of the bottle. In most instances the transitional section between the first and second body sections comprises a relatively smooth reduction in the size of the body sections from the first to the second sections, with the sides of the bottle sloping from the first body section toward the second body section. However, depending upon the design of the bottle, the shoulder could have a relatively sharp angle as it transitions from the larger first body section to the relatively smaller second section. As described in greater detail below, the flashlight lens and bulb assembly are located at the outer end of the first body section.

Depending upon the particular shape of the body 12, the border or transition between the three body sections described above may not be sharp and distinct. Nonetheless, for purposes herein, the first body section 14 ends and the transitional body section 18 begins where the shoulder section of the bottle begins. This is generally at a position where the relatively larger outer diameter first body section begins to be reduced in diameter moving in the direction from the base end of the bottle toward the neck end of the bottle. Similarly, the transitional body section ends and the second body section begins at the position where the shoulder of the bottle stops. Thus, the second body section starts at that position where the reduction in the outer diameter of the body attributable to the transitional section stops. The demarcation between the three body sections may be relatively more clear in a body style that has a sharply angled shoulder or transition area, for example where the side of the bottle juts inwardly at approximately a right angle at the transition between the first body section and the transitional body section.

As illustrated in FIGS. 1 and 2, the general appearance of a bottle is achieved by providing first body section 14 with a greater outer diameter than the outer diameter of second body section 16, with transitional body section 18 forming a gradual sloping shoulder therebetween. In the embodiment of FIG. 1, the outer diameter of second body section 16 measured at the point of second body section 16 that has the greatest outer diameter (dimension X in FIG. 1) is no greater than about 70% of the size of the outer diameter of first body section 14 measured at the point of first body section 14 that has the greatest outer diameter (dimension Y in FIG. 1). The length of second body section 16 is no less than about 25% of the total length of body 12, which for purposes herein does not include the length of threaded shaft 34.

While these dimensions shown in FIG. 1 contribute to the overall bottle-like appearance of the flashlight body shown in FIG. 1, the relative dimensions may be varied widely while still replicating accurately the shape of a bottle having a three-section body. Thus, the flashlight of the present invention may be formed in the shape of virtually any bottle having a three-section body comprising a base, a shoulder, and a neck. For example, FIG. 3 shows a flashlight 10 according to the present invention that has a body 12 formed in the shape of a conventional 20 fluid ounce soda bottle that has a screw-on plastic cap. The body includes a first body section 14 that extends from the base end of the body to the transitional body section 18, which in turn extends to second body section 16. The first body section represents the base of the soda bottle, the transitional body section represents the shoulder, and the second body section represents the neck. As with the embodiment of FIG. 1, the outer diameter of first body section 14 is greater than the outer diameter of second body section 16, with transitional body section 18 forming the transition therebetween.

In the embodiment of FIG. 3, the outer diameter of second body section 16 measured at the point of second body section 16 that has the greatest outer diameter (dimension X in FIG. 3) is no greater than about 40% of the size of outer diameter of first body section 14 measured at the point of first body section 14 that has the greatest outside diameter (dimension Y in FIG. 3). The length of second body section 16 is no less than about 15% of the total length of body 12.

Yet another embodiment of a neck-end 35 is illustrated in FIG. 5, which illustrates the neck-end of a flashlight formed in the shape of a traditional wine bottle.

The mechanical aspects of flashlight 10 are generally conventional and are well within the skill of those versed in the art. As illustrated in FIG. 2, body 12 has a hollow core 20 sized for enclosing a battery 22. The flashlight illustrated in the embodiment shown in FIG. 2 includes a single battery 22. Accordingly, the flashlight illustrated in FIG. 2 is a miniature model that contains, for example, a single battery of the standard size designation AAA. The illustration of FIG. 2 is for explanatory purposes only and the invention described herein is not limited to any particular body size or battery type. For example, flashlight body 12 could be of a size suitable for accommodating two or more batteries of the standard size designation D, which would be arranged in core 20 in a physical series as is well known in the art.

A lens assembly 24 is fitted into core 20 at outer end 26 of body 12 in a position to direct a beam of light therefrom when the electrical circuit in the flashlight is closed, thereby illuminating the lamp bulb. For reference purposes, the outermost end of body 12 with lens assembly 24 in place is referred to as the base end 31 of the flashlight. In FIG. 2, lens assembly 24 is threaded into a mating threaded passageway 25 in core 20 sized to accept the lens assembly. However, lens assembly 24 could be inserted into core 20 in any well-known manner. Lens assembly 24 includes a mirrored reflector 26, a lens 28, and a lamp bulb 30. A spring 32 is position between the base of lens assembly 24 in the interior of core 20 when lens assembly 24 is fitted into the core. Spring 32 is friction fitted around the base 31 of lens assembly 24 such that the spring remains attached to lens assembly 24 when the later is removed from position in core 20.

The electrical components of the flashlight of the present invention are conventional and as such are well within the abilities of those of ordinary skill in the art. The particular switch assembly and electrical components discussed below refer to a flashlight having an electrically conductive body. However, the present invention is not limited to flashlights having conductive casings, but as will be appreciated, the electrical components including the switch vary in well known manners depending upon the materials used in the flashlight.

In the embodiment of FIG. 2, a switch assembly, designated generally with reference number 33, is located at the end of body 12 opposite base end 31. For reference purposes, the outer end 38 of body 12 is referred to as the neck end of the flashlight. Switch assembly 33 includes an electrically conductive threaded shaft 34 that is threaded through a threaded bore 36 in outer end 38 of body 12. In the embodiment shown in FIG. 2, threaded shaft 34 functions as the on-off switch for the flashlight. When assembled with a battery 22 inserted into core 20, the interior distal end 40 of threaded shaft 34 is biased into contact with the negative end or pole 42 of battery 22 by spring 32, which is in contact with the positive end 44 of the battery.

The electrical circuit is open and the flashlight is off when threaded shaft 34 is in a position such that the positive terminal on battery 22 is not in contact with electrical contact 46 in the base of lamp bulb 30. To switch the flashlight to the on position and illuminate lamp bulb 30, threaded shaft 34 is rotated to move distal end 40 inwardly in core 20 toward base end 31, thereby closing the circuit formed by the components described. Screwing threaded shaft 34 inwardly—that is, in the clockwise direction—urges battery 22 toward lamp bulb 30 against the biasing force of spring 32. When threaded shaft 34 has been rotated sufficiently to move the positive terminal of battery 22 into contact with electrical contact 46 of lamp bulb 30, the circuit is closed and lamp bulb 30 illuminates. Rotating threaded shaft 34 in the opposite direction (counterclockwise) until the biasing force of spring 32 moves battery 22 away from lamp bulb 30 and out of contact therewith opens the circuit, ceasing illumination of the lamp bulb.

Threaded shaft 34 includes a bore 48 formed through the shaft near the outermost end thereof. Bore 48 is optional, but is useful for connecting the entire flashlight to, for example, a key chain or a tether.

While the location of the switch shown in the drawings is not critical to the present invention, in some embodiments the position of the on-off switch may lend itself to the overall theme of the present invention, which is that of replicating with a flashlight, the shape of a bottle. Thus, in the embodiments shown in the figures, the user-operated portion of the on-off switch is positioned at the neck end 35 of body 12. Rotation of threaded shaft 34 to alternately open and close the electrical circuit simulates the twisting on and off of a bottle cap to open and close the bottle.

In the embodiment shown in FIG. 4, end 38 of neck end 35 has been manufactured to resemble a traditional twist-off bottle cap, which is designated with reference number 50. The scalloped edge 51 of cap 50 contributes to the appearance of the cap such that the cap substantially replicates the appearance of a standard twist-off cap. In this embodiment, threaded shaft 34 extends completely through end 38 of body 12, as detailed above with regard to FIG. 2. Rotating threaded shaft 34 to switch the light on and off simulates the twisting on and off of the bottle cap 50, although the simulated bottle cap 50 need not itself rotate. Alternatively, bottle cap 50 may be journaled to end 38 of body 12 such that bottle cap 50 is itself rotatable. In that case, rotation of bottle cap 50 drives an internal shaft (not shown) with appropriate mechanical connections into position to close, and alternately open the electrical circuit to illuminate and turn-off the lamp bulb.

The flashlight of the present invention is useful for most any purpose a flashlight may be used, but is also particularly useful as a novelty item. For example, the flashlight may be used as a product for marketing and otherwise promoting beverage products sold under various trademarks and brand names. Thus, in accordance with the general theme of a bottle, written indicia may be printed onto the outside surface of body 12 to replicate the appearance of branded beverage products. As just one example, well-known brand names for soda beverages may be reproduced on the outer surface of the flashlight body to fully give the appearance of a bottle of such beverage. Typically, such written indicia would be printed on the outer surface of the first body section. However, the transitional body section and the second body section may also be printed with written matter depending upon the type of bottle that is being replicated. Written indicia may also be printed on end 38. Thus, end 38 may be printed with, for example, brand names and directional arrows showing the direction in which a bottle cap should be twisted, or with arrows indicating the direction of rotation to turn the lamp bulb on and off.

In view of the many possible embodiments to which the principles of my invention may be applied, it should be recognized that the detailed embodiments are illustrative only and should not be taken as limiting the scope of my invention. Rather, I claim as my invention all such embodiments as may come within the scope and spirit of the following claims and equivalents thereto.

What is claimed is:

1. A novelty flashlight having a body formed substantially in the shape of a bottle, comprising:

a flashlight body having a first and second end, a hollow core for holding a battery, a first body section representing the base of the bottle and having a first outer diameter, a second body section representing the neck of the bottle and having a second outer diameter, and a transitional body section therebetween representing the shoulder of the bottle, the outer diameter of the second body section being substantially smaller than the outer diameter of the first body section;

a lens assembly at the first end of the flashlight body and including a lens, a lamp bulb and a reflector;

an electrical circuit sufficient to provide an electrical connection for illuminating the lamp bulb; and a switch operable for alternately closing and opening the electrical circuit.

2. The novelty flashlight according to claim 1 in which the outer diameter of the second body section is no greater than about 70% of the outer diameter of the first body section.

3. The novelty flashlight according to claim 1 in which the length of the second body section is no less than about 25% of the length of the flashlight body.

4. The novelty flashlight according to claim 3 in which the length of the second body section is no less than about 25% of the length of the flashlight body.

5. The novelty flashlight according to claim 1 in which the switch includes a rotatable element at the second end of the flashlight body, and wherein the rotatable element is operable for closing the electrical circuit to illuminate the lamp bulb when rotated in a first direction, and to open the electrical circuit when rotated in a second direction.

6. The novelty flashlight according to claim 5 in which rotation of the rotatable element simulates the rotation of a bottle cap.

7. The novelty flashlight according to claim 5 in which the rotatable element comprises a cap attached to the end of the second body section and including a scalloped edge to reproduce the appearance of a twist-off bottle cap.

8. The novelty flashlight according to claim 1 in which the outer diameter of the second body section is no greater than about 40% of the outer diameter of the first body section, and wherein the length of the second body section is no less than about 16% of the length of the flashlight body.

9. The novelty flashlight according to claim 1 including written indicia on the outer surface of the flashlight body, the written indicia representing a name for a beverage product.

10. In a flashlight having a flashlight body configured to substantially reproduce the appearance of a bottle, the flashlight body including a first and second end and a hollow core therebetween for holding a plurality of batteries, a lens assembly at the first end of the flashlight body including a lens, a lamp bulb and a reflector, and an electrical circuit sufficient to provide an electrical connection for illuminating the lamp bulb and a switch for alternately closing and opening the electrical circuit, the improvement comprising:

the flashlight body including:

(a) a first body section having a first outer diameter;

(b) a second body section having a second outer diameter;

(c) a transitional body section between the first and second body sections;

wherein, the size of the second outer diameter is no greater than about 70% of the size of the size of the first outer diameter.

11. The flashlight according to claim 10 in which the length of the second body section is no less than about 25% of the length of the flashlight body.

12. The novelty flashlight according to claim 10 including written indicia on the outer surface of the flashlight body, the written indicia representing a name for a beverage product.

13. A novelty flashlight having a flashlight body formed substantially in the shape of a bottle, comprising:

a flashlight body having a first and second end, a hollow core for holding a battery, a first body section representing the base of the bottle and having a first outer diameter, a second body section representing the neck of the bottle and having a second outer diameter, and a transitional body section therebetween representing the shoulder of the bottle, the outer diameter of the second body section being no greater than about 70% of the outer diameter of the first body section, and the length of the second body section being no less than about 25% of the length of the flashlight body;

a lens assembly at the first end of the flashlight body and including a lens, a lamp bulb and a reflector;

an electrical circuit sufficient to provide an electrical connection for illuminating the lamp bulb; and a switch operable for alternately closing and opening the electrical circuit and including a rotatable element positioned at the second end of the flashlight body and operable for closing the electrical circuit to illuminate the lamp bulb when rotated in a first direction, and to open the electrical circuit when rotated in a second direction.

14. The novelty flashlight according to claim 13 in which the rotatable element comprises a cap connected to the end of the second body section and including a scalloped edge to substantially replicate the appearance of a twist-off bottle cap.

15. The novelty flashlight according to claim 13 including written indicia on the outer surface of the flashlight body, the written indicia representing a name for a beverage product.

* * * * *